US005719524A

United States Patent [19]

Mo et al.

[11] Patent Number: 5,719,524

[45] Date of Patent: Feb. 17, 1998

[54] CIRCUIT HAVING AN INPUT TERMINAL FOR CONTROLLING TWO FUNCTIONS

[75] Inventors: Zhong Heng Mo, Daly City; Brian Gillings, San Jose, both of Calif.

[73] Assignee: TelCom Semiconductor, Inc., Mountain View, Calif.

[21] Appl. No.: 540,816

[22] Filed: Oct. 11, 1995

[51] Int. Cl.[6] ..... G05F 1/10

[52] U.S. Cl. ..... 327/545; 327/72

[58] Field of Search ..... 327/72, 52, 53, 327/56, 90, 538, 540, 541, 543, 545, 546, 561, 562, 563; 330/254

[56] References Cited

U.S. PATENT DOCUMENTS

| | | | |
|---|---|---|---|
| 4,752,700 | 6/1988 | Boyacigiller | 327/1 |
| 4,797,569 | 1/1989 | Boyacigiller | 327/54 |
| 5,105,102 | 4/1992 | Shioda | 327/541 |
| 5,214,316 | 5/1993 | Nagai | 327/545 |
| 5,287,011 | 2/1994 | Koshikawa et al. | 327/545 |
| 5,451,896 | 9/1995 | Mori | 327/546 |
| 5,457,421 | 10/1995 | Tanabe | 327/546 |
| 5,504,452 | 4/1996 | Takenaka | 327/546 |
| 5,530,388 | 6/1996 | Honnigford | 327/546 |

*Primary Examiner*—Timothy P. Callahan
*Assistant Examiner*—My-Trang Nu Ton
*Attorney, Agent, or Firm*—Skjerven, Morrill, MacPherson, Franklin & Friel; Brian D. Ogonowsky

[57] ABSTRACT

An integrated circuit providing two output functions from a single output controlled by an input with a single switch responsive to an input level.

25 Claims, 4 Drawing Sheets

CIRCUIT HAVING AN INPUT TERMINAL FOR CONTROLLING TWO FUNCTIONS

BACKGROUND OF THE INVENTION

1. Field of the Invention

This invention relates generally to integrated circuits, and, more particularly, to integrated circuits in which one input controls two functions from one output.

2. Discussion of the Related Art

It is becoming mandatory for integrated circuits to be electrically efficient as well as spatially efficient. Therefore, whenever possible, it is desirable to use electrically and spatially efficient transistors and to decrease the number of transistors and elements in a circuit as well. NMOS or n-channel transistors should be used when possible rather than PMOS or p-channel transistors because NMOS devices can be made smaller and thus operate faster than PMOS devices. Even though complementary MOS (CMOS) technology is becoming more popular because it offers powerful circuit-design possibilities, it is still desirable to use NMOS transistors rather than CMOS for the same reasons.

In addition, because it is desirable to provide as many functions as possible for each integrated circuit device and because it is necessary to keep the pin count low it is becoming mandatory to provide more than one function per output pin controllable by a single input.

The related art shows integrated devices which output two functions from a single output terminal by changing the input to a single input terminal. For example, U.S. Pat. Nos. 4,752,700 and 4,797,569 each teach a device that provides two functions from a single output terminal by varying the input to an input terminal. However, the devices taught in these two patents have two switches which change state responsively to an input from a comparator/inverter circuit. The two switches are CMOS transistors which are not as spatially efficient or as electrically efficient as a single NMOS transistor.

As designers of integrated circuits attempt to squeeze more functions into an integrated circuit it becomes more and more desirable to decrease the number of circuit elements as well as the number and kind of transistors needed to achieve a particular function.

SUMMARY OF THE INVENTION

According to the present invention, an integrated circuit provides two output functions from a single output terminal controlled by an input to an input terminal. In the preferred embodiment, a single switch controlled by a circuit responsive to the input controls which of two output functions appears at an output terminal.

The present invention utilizes two circuits to provide two output functions. The two circuits are voltage divider circuits which utilize an amplifier to provide predefined function levels to an output terminal. A circuit with a comparator responsive to a level at an input terminal controls the state of the switch. The preferred embodiment of the present invention utilizes a single n-channel MOSFET acting as a switch.

The present invention is better understood upon consideration of the detailed description below, in conjunction with the accompanying drawings.

DETAILED DESCRIPTION OF THE PREFERRED EMBODIMENT

Figure 1:
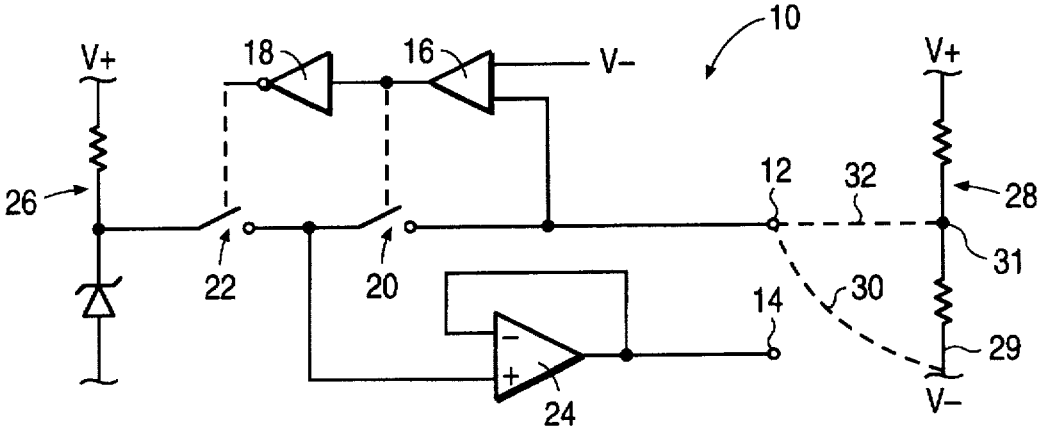
FIG. 1 (PRIOR ART)
FIG. 1 shows a simplified block diagram of a prior art device.

Referring first to FIG. 1, a simplified block diagram of a prior art device is shown. The circuit 10 has an input terminal 12, an output terminal 14, a comparator 16, an inverter 18, a first switch 20, a second switch 22, an amplifier 24, an internal voltage source 26, an external voltage source 28, a positive DC supply voltage $V^+$, and a negative DC voltage V.

The circuit 10 operates by applying either a negative DC V voltage 29 to input terminal 12, depicted by dashed line 30, or a voltage at node 31 from voltage source 28, depicted by dashed line 32. When the comparator 16 detects the negative DC at the input terminal 12 the output of comparator 16 causes switch 20 to open and the output of inverter 18 causes switch 22 to close. With switch 22 closed and switch 20 open the output of voltage supply 26 is at the noninverting input of the amplifier 24 and the voltage at output 14 will be a function of the voltage from voltage supply 26.

When comparator 16 detects the voltage from voltage source 28 at input 12, comparator 16 causes switch 20 to close and invertor 18 causes switch 22 to open. In this case the voltage from voltage source 28 is at the noninverting input of amplifier 24 and the voltage at output 14 will be a function of the voltage from voltage supply 28.

Figure 2:
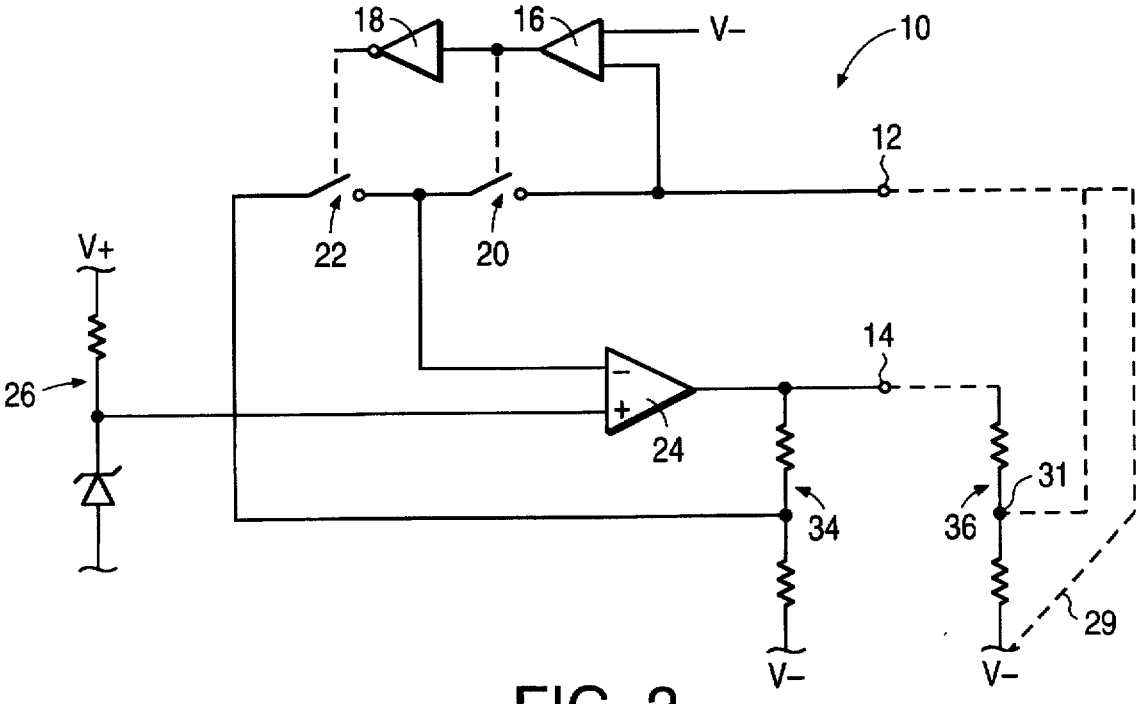
FIG. 2 (PRIOR ART)
FIG. 2 shows the prior art device of FIG. 1 utilizing feedback for improved accuracy and stability.

Referring now to FIG. 2, there is shown the circuit shown in FIG. 1 with the implementation of feedback to obtain added accuracy to the output of amplifier 24. Features of FIG. 2 that are the same as in FIG. 1 share the same numerical labels. If switch 22 is closed and switch 20 is open a portion of the output of amplifier 24 will be returned to the inverting input of amplifier 24 via voltage divider circuit 34. If switch 20 is closed and switch 22 is open a portion of the output of amplifier 24 will be returned to the inverting input of amplifier 24 via voltage divider 36.

Figure 3:
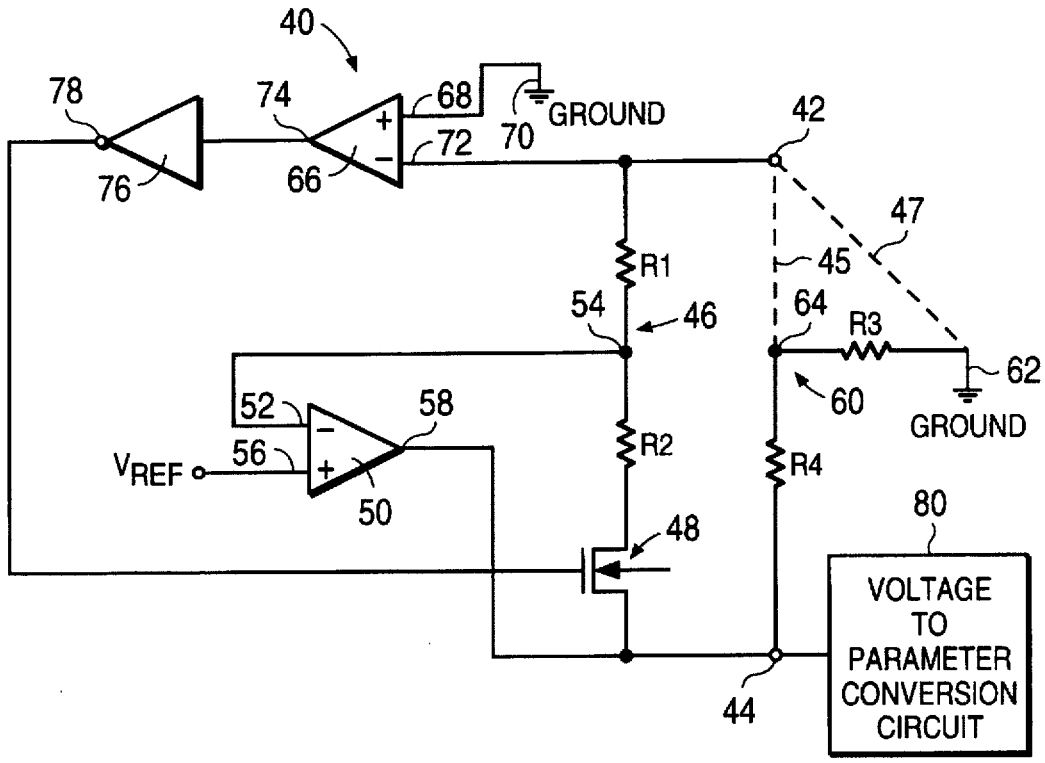
FIG. 3 is a simplified block diagram of the present invention.

Referring now to FIG. 3, a simplified block diagram of the preferred embodiment of the present invention is shown. Circuit 40 includes an input terminal 42, an output terminal 44, a first circuit 46 made up of resistor R1, resistor R2, and transistor 48 connected in series between input terminal 42 and output terminal 44, and amplifier 50 with inverting input 52 connected to node 54 between resistor R1 and resistor R2, with noninverting input 56 connected to $V_{REF}$, and an output 58 connected to output terminal 44. Circuit 40 further includes a second circuit 60 made up of resistor R3 and resistor R4 connected in series between ground terminal 62 and output terminal 44. Node 64 between resistor R3 and resistor R4 is user connectable to input terminal 42 as indicated by dashed line 45. Ground terminal 62 is alternatively user connectable to input terminal 42 as indicated by dashed line 47. Circuit 40 also includes comparator 66 with input 68 connected to ground terminal 70, with input 72 connected to input terminal 42, and output 74 connected to inverter 76 which has output 78 connected to transistor 48. Also shown is a voltage to parameter conversion circuit 80. As is well known in the art the output voltage can be used to drive other circuits such as a voltage to frequency circuit or a voltage to current circuit. It is intended that other conversion circuits are comprehended by this invention. Such conversion circuits could be included as part of the integrated circuit.

The operation of circuit 40, FIG. 3 is as follows. When GROUND terminal 62 is applied to input terminal 42, output 74 of comparator 66 goes to logic LOW and output 78 of inverter 76 goes to logic HIGH. The logic HIGH from invertor 76 is applied to the gate of n-channel MOSFET 48 causing it to turn ON.

Figure 4:
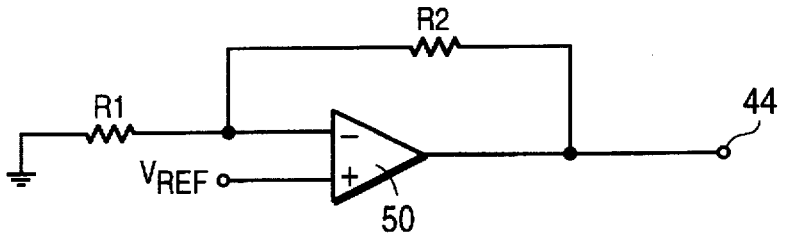
FIG. 4 is a depiction of the circuit resulting from the application of a first voltage to the input terminal.

FIG. 4 shows the circuit resulting from the application of GROUND to input terminal 42. The resistors R1 and R2 form a feedback circuit for amplifier 50 and assuming an ideal operational amplifier the voltage $V_o$ at output terminal 44 is calculated to be $V_o = V_{REF}(1+R_2/R_1)$.

Referring again to FIG. 3, when node 64 is connected to input terminal 42, output 74 of Comparator 66 goes to logic HIGH causing output 78 of inverter 76 to logic LOW. The logic LOW applied to the gate of n-channel MOSFET 48 causes n-channel MOSFET 48 to turn OFF which disconnects circuit 46 from the output.

Figure 5:
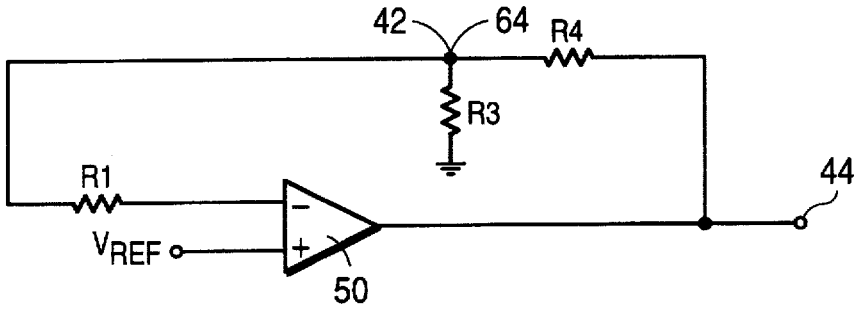
FIG. 5 is a depiction of the circuit resulting from the application of a second voltage to the input terminal.

FIG. 5 shows the circuit resulting from the application of node 64 to input terminal 42. The resistors R3 and R4 form a feedback circuit for amplifier 50 and assuming an ideal operational amplifier the voltage $V_o$ at output terminal is calculated to be $V_o = V_{REF}(1+R_4R_3)$.

Figure 6:
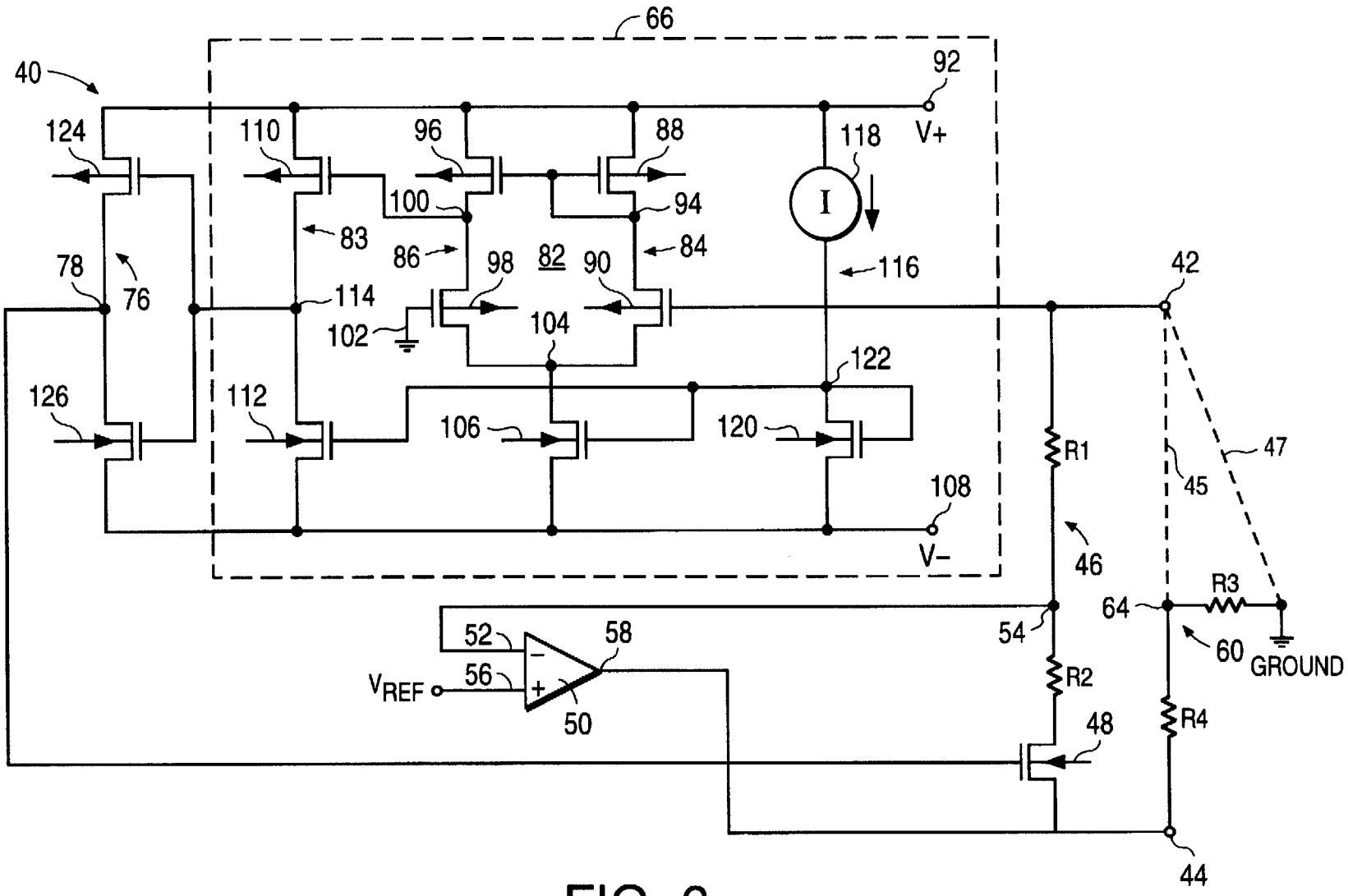
FIG. 6 is a schematic of the present invention shown in FIG. 3.

Referring now to FIG. 6 which is a schematic of the block diagram of FIG. 3, the detailed description of comparator circuit 66 is as follows. The same numerical labels shown in FIG. 3 are repeated for common elements shown in FIG. 6. Comparator circuit 66 shown delineated by dashed outline in FIG. 6 includes a CMOS comparator having two stages, a first stage 82, known in the art as a differential stage, and a second stage 83, known in the art as an inverting stage. The use of a two-stage comparator is preferred because the differential stage has poor gain which can be augmented by the use of an inverting stage. It should be apparent that other comparator configurations could be used and be within the intended scope of the present invention.

First stage 82 has two legs, 84 and 86. Leg 84 is made up of p-channel MOSFET 88 and n-channel MOSFET 90. The source of p-channel MOSFET 88 is connected to positive supply voltage 92, the drain of p-channel MOSFET 88 is connected to the drain of n-channel MOSFET 90 thus forming a node 94. The gate of p-channel MOSFET 88 is connected to node 94.

Leg 86 is made up of p-channel MOSFET 96 and n-channel MOSFET 98. The source of p-channel MOSFET 96 is connected to positive supply voltage 92, the drain of p-channel MOSFET 96 is connected to the drain of n-channel MOSFET 98 forming a node 100. The gate of p-channel MOSFET 96 is connected to node 94. The gate of n-channel MOSFET 98 is connected to GROUND terminal 102.

The sources of n-channel MOSFETs 90, 98 are connected forming a node 104 which is connected to the drain of n-channel MOSFET 106. The source of n-channel MOSFET 106 is connected to negative supply voltage terminal 108. The gate of n-channel MOSFET 106 is connected to bias circuit 116. N-channel MOSFET 106 acts as a current sink for first stage 82.

Second stage 83 is made up of p-channel MOSFET 110 and n-channel MOSFET 112. The source of p-channel MOSFET 110 is connected to positive supply voltage terminal 92 and the drain of p-channel MOSFET 110 is connected to the drain of n-channel MOSFET 112 forming an output node 114. The gate of p-channel MOSFET 110 is connected to node 100. The source of n-Channel MOSFET 112 is connected to negative supply voltage terminal 108 and the gate of n-channel MOSFET 112 is connected to bias circuit 116.

Bias circuit 116 is made up of constant current source 118 and n-channel MOSFET 120. Constant current source 118 is connected between positive supply voltage terminal 92 and the drain of n-channel MOSFET 120. The source of n-channel MOSFET 120 is connected to negative supply voltage terminal 108. The gate of n-channel MOSFET 120 is connected to the drain of n-channel MOSFET 120 forming a node 122. The gates of n-channel MOSFETs 106, 112 are connected to node 122.

The output of comparator circuit 66 is input to inverter 76. Inverter 76 is made up of p-channel MOSFET 124 and n-channel MOSFET 126. The source of p-channel MOSFET 124 is connected to positive supply voltage terminal 92 and the drain of p-channel MOSFET 124 is connected to the drain of n-channel MOSFET 126 forming output node 78 which is connected to the gate of transistor 48. The gates of p-channel MOSFETs 124, 126 are connected to node 114.

The operation of comparator circuit 66, FIG. 6 is best analyzed by first discussing how it is to function. As discussed above in relation to FIG. 3, when GROUND potential is input to input terminal 42, node 114, the output of comparator circuit 66, is to be at logic LOW which is input to inverter 76 which outputs logic HIGH. Similarly, when a second voltage at node 64 is input to input terminal 42, node 114 is to be at logic HIGH which is input to inverter 76 which outputs logic LOW. To achieve these results the two stages 82,83 of comparator 66 and bias circuit 116 are designed as follows.

If p-channel MOSFETs 88,96 and n-channel MOSFETs 90, 98 are matched, then with equal inputs, such as GROUND, equal currents would flow through legs 84, 86 and the voltage at node 100 will be at a certain level. The voltage at node 100 is input to the gate of p-channel 110 and controls the current through second stage 83. Similarly, when a second voltage is input to input terminal 42 the currents flowing through legs 84, 86 will become unequal and the voltage at node 100 will change, either more positive or more negative, depending upon the value and polarity of the second voltage applied to input terminal 42. As can be appreciated this will either increase or decrease the current flow through second stage 83 depending upon the value and polarity of the voltage change at node 100. In the preferred embodiment of the present invention, the second voltage present at node 64 is derived from circuit 60 and is a function of the output of amplifier 50 and the values of resistors R3 and R4. The output of amplifier 50 is dependent upon the value of $V_{REF}$ and in the preferred embodiment $V_{REF}$ is approximately −1.28 volts. In this case, the voltage at node 64 which is to be input to input terminal 42 and thus to the gate of n-channel MOSFET 90 is −1.28 volts which is the offset voltage of amplifier 50. The −1.28 volts at the node 42 is more negative than a trip voltage, which will be defined and discussed later, of the comparator 83.

To achieve the largest swing in the voltage at node 100 when the alternate inputs are input it is desirable to adjust first stage 82 such that the currents are not equal through legs 84, 86 when equal voltages are applied to the gates of n-channel MOSFETs 90, 98. This can be accomplished in several ways, however, one of the 30 simplest and most accurate way is to adjust the relative dimensions of specific MOSFETs during processing. If the size of n-channel MOSFET 90 is made larger than the size of n-channel MOSFET 98 more current will flow through leg 84 than leg 86 when equal voltages are applied to the gates of n-channel MOSFETs 90, 98. The trip voltage is defined as that voltage that when input to n-channel MOSFET 90 will cause equal currents to flow in legs 84, 86. As can be appreciated the setting of the trip voltage between the two alternative voltages that will be applied to input terminal 42 will tend to maximize the swing in the voltage at node 100.

When the size of n-channel MOSFET 90 is larger than the size of n-channel MOSFET 98, equal currents through leg 84 and leg 86 is achieved when the input voltage at the gate of n-channel MOSFET 90 is more negative than the input voltage at the gate of n-channel 98. As discussed above, this more negative voltage is the trip voltage of the comparator circuit.

With the trip voltage more negative, and in this case the trip voltage is on the order of −100 mV the application of GROUND to input terminal 42 causes the output of the comparator to be as follows. Since GROUND potential is more positive than the trip voltage the voltage at node 94 will be more negative than when the currents were equal and this more negative voltage will be applied to the gate of p-channel MOSFET 96. This more negative voltage at the gate of p-channel MOSFET 96 will cause more current to flow through leg 86 and thus the voltage at node 100 will become more positive than when the currents were equal. With the more positive voltage at node 100 being applied to the gate of p-channel MOSFET 110 the current through p-channel MOSFET 110 will decrease and the voltage at node 114 is defined as logic LOW. With logic LOW at node 114 which is the input to inverter 76 the output of inverter 76 will be logic HIGH.

Alternatively, when a voltage more negative than the trip voltage, such as that at node 64 of circuit 60, is applied to input terminal 42, the analysis is as follows. A voltage more negative than the trip voltage applied to the gate of n-channel MOSFET 90 will tend to turn n-channel MOSFET 90 OFF. This will cause the voltage at node 94 to become more positive. This more positive voltage which will be applied to the gate of p-channel MOSFET 96 will tend to turn p-channel MOSFET 96 OFF. This, in turn, will cause node 100 to become more negative which will cause the gate of p-channel MOSFET 110 to increase the current through p-channel MOSFET 110. Node 114 will then become more positive and is defined as logic HIGH. With node 114 at logic HIGH, the output of inverter 76 will be at logic LOW. This will turn n-channel MOSFET 48 OFF disconnecting voltage divider circuit 46 from output terminal 44.

Figure 7:
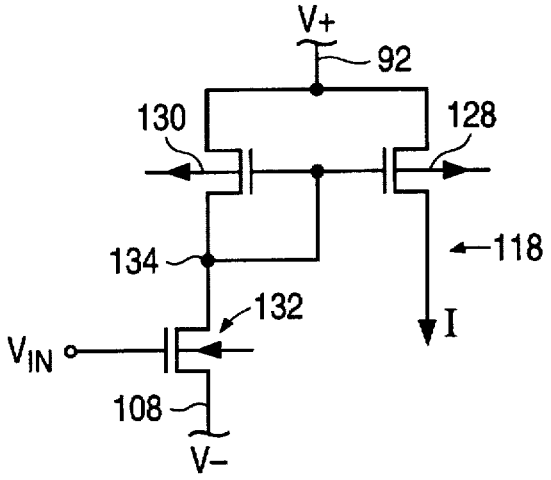
FIG. 7 is a schematic of a constant current source at can be used in the present invention.

Referring to FIG. 7 there is shown an example of a constant current source that may be used in the present invention. It should be apparent that other configurations of a constant current source could be used and still be within the scope of the present invention. The constant current source 118 shown in FIG. 7 has the sources of first and second p-channel MOSFETs 128, 130 connected to positive supply voltage 92, the drain of n-channel MOSFET 132 connected to the drain of p-channel MOSFET 130 forming a node 134. The gates of p-channel MOSFET 130, 132 are connected to node 134 forcing p-channel MOSFET 130 to operate in the saturation mode. The source of n-channel MOSFET 132 is connected to negative supply voltage 108. The gate of n-channel MOSFET 132 is connected to a reference voltage $V_{IN}$ which controls the amount of current that is supplied by the constant current source. The correct voltage $V_{IN}$ can be obtained from the positive and negative supply voltages by means well known the art.

The detailed description provided above is intended to be illustrative of the disclosed embodiment, and is not intended to be limiting of the present invention. Numerous modifications and variations are possible within the scope of the present invention. The present invention is defined by the following claims appended hereto.

What we claim is:

1. An integrated circuit having an input terminal and an output terminal comprising:

an operational amplifier having a noninverting input terminal and an inverting input terminal;

a first feedback circuit switchably connected to the inverting input terminal of the operational amplifier;

a second feedback circuit switchably connected to the inverting input terminal of the operational amplifier;

a single switch responsive to a voltage level input to the input terminal, wherein the single switch in a first state controls the connection of the first feedback circuit to the operational amplifier and in a second state controls the connection of the second feedback circuit to the operational amplifier; and a comparator circuit responsive to the voltage level input to the input terminal to control the state of the single switch.

2. An integrated circuit as in claim 1, wherein the first feedback circuit comprises a first voltage divider circuit.

3. An integrated circuit as in claim 2, whrerein said first voltage divider circuit comprises a first resistor and a second resistor connected in series with a first terminal of said single switch and the operational amplifier having an output connected in parallel with said second resistor and said single switch, a second terminal of said single switch and said operational amplifier output being connected to said output terminal, said operational amplifier having a first reference voltage connected to the noninverting input wherein the output of the first voltage divider circuit comprises a first output function and is a function of the first reference voltage and a ratio of the first and second resistors.

4. An integrated circuit as in claim 3, wherein said second feedback circuit comprises a second voltage divider circuit.

5. An integrated circuit as in claim 4, wherein said second voltage divider circuit comprises a third resistor and a fourth resistor connected in series between a voltage source and said output terminal.

6. An integrated circuit as in claim 5, wherein said second voltage divider circuit further comprises said operational amplifier having said inverting input connected in series with said first resistor and said fourth resistor and the operational amplifier output connected to the output terminal wherein the output of the second voltage divider circuit comprises a second output function which is a function of the first reference voltage and a ratio of the third and fourth resistors.

7. An integrated circuit as in claim 6, wherein the comparator circuit comprises a comparator with a first input connected to the input terminal and a second input connected to a second reference voltage.

8. An integrated circuit as in claim 7, wherein the comparator circuit further comprises a bias circuit connected between a positive supply terminal and a negative supply terminal such that:

when a first voltage is detected at the input terminal the output of the comparator enables the first voltage divider circuit, wherein the output of the first voltage divider circuit is at the output terminal; and when a second voltage is detected at the input terminal the output of the comparator disables the first voltage divider circuit, wherein the output of the second voltage divider circuit is at the output terminal.

9. An integrated circuit as in claim 8, wherein the comparator circuit further comprises an inverter with an input connected to an output of said comparator and an output connected to said single switch.

10. An integrated circuit as in claim 9, wherein said comparator comprises a first stage and a second stage.

11. An integrated circuit as in claim 10, wherein said first stage comprises a first leg and a second leg:

wherein said first leg has an input connected to said input terminal and an output connected to said second leg; and wherein said second leg has an input connected to the second reference voltage.

12. An integrated circuit as in claim 11 wherein said first stage has a trip point voltage such that when said first voltage is detected at the input terminal the output of said comparator is at a logic LOW and when said second voltage is detected at the input terminal the output of said comparator is at a logic HIGH.

13. An integrated circuit as in claim 12:

wherein said first leg comprises a first p-channel MOSFET with a source connected to a first supply voltage, a drain connected to a drain of a first n-channel MOSFET forming a first node, and a gate connected to said first node, said first n-channel MOSFET having a gate connected to the input terminal and having a source;

wherein said second leg comprises a second p-channel MOSFET with a source connected to the first supply voltage, a drain connected to a drain of a second n-channel MOSFET forming a second node, and a gate connected to said first node, said second n-channel MOSFET having a gate connected to said second reference voltage and having a source connected to said source of said first n-channel MOSFET forming a third node.

14. An integrated circuit as in claim 13 wherein said first stage further comprises a third n-channel MOSFET having a drain connected to the third node, a source connected to a second supply voltage, and having a gate connected to said bias circuit.

15. An integrated circuit as in claim 14 wherein said second stage comprises:

a third p-channel MOSFET having a source connected to the first supply voltage, a gate connected to said second node, and a drain;

a fourth n-channel MOSFET having a source connected to the second supply voltage, a gate connected to said bias circuit, and a drain connected to said drain of said third p-channel MOSFET forming a fourth node.

16. An integrated circuit as in claim 15 wherein: said first and second p-channel MOSFETs are a matched pair; and said first n-channel MOSFET is larger than said second n-channel MOSFET such that said trip point voltage is set more negative than said second reference voltage.

17. An integrated circuit as in claim 16 wherein said inverter comprises:

a fourth p-channel MOSFET having a source connected to the first supply voltage, a gate connected to said fourth node, and a drain; and a fifth n-channel MOSFET having a source connected to the second supply voltage, a gate connected to said fourth node, and a drain connected to said drain of said fourth p-channel MOSFET forming a fifth node comprising the output of the inverter.

18. An integrated circuit as in claim 17 wherein said bias circuit comprises:

a constant current source with an input connected to the first supply voltage and an output; and a sixth n-channel MOSFET having a source connected to the second supply voltage, a gate connected to a drain forming a sixth node connected to said output of said constant current source.

19. An integrated circuit as in claim 18 wherein said sixth node is connected to the gates of said third n-channel MOSFET and said fourth n-channel MOSFET such that said third n-channel MOSFET and said fourth n-channel MOSFET function as current sinks.

20. An integrated circuit as in claim 19 wherein said constant current source comprises a fifth p-channel MOSFET having a source connected to the first supply voltage, a gate connected to a third reference voltage, and a drain connected to the sixth node.

21. An integrated circuit as in claim 20 wherein the first reference voltage is approximately −1.28 volts.

22. An integrated circuit as in claim 21 wherein the second reference voltage is GROUND.

23. An integrated circuit as in claim 22 wherein the trip point voltage is approximately −100mY.

24. An integrated circuit as in claim 22 wherein the first voltage input to said input terminal is GROUND.

25. An integrated circuit as in claim 23 wherein the second voltage input to said input terminal is more negative than said trip point voltage.

* * * * *